US009752261B2

(12) United States Patent
Hayashida et al.

(10) Patent No.: US 9,752,261 B2
(45) Date of Patent: Sep. 5, 2017

(54) CLOTH EDGE CURL CORRECTION DEVICE

(71) Applicant: Yamato Mishin Seizo Kabushiki Kaisha, Osaka-shi, Osaka (JP)

(72) Inventors: Takayuki Hayashida, Toyonaka (JP); Takashi Iba, Toyonaka (JP)

(73) Assignee: Yamato Mishin Seizo Kabushiki Kaisha, Osaka-shi, Osaka (JP)

( * ) Notice: Subject to any disclaimer, the term of this patent is extended or adjusted under 35 U.S.C. 154(b) by 452 days.

(21) Appl. No.: 14/491,768

(22) Filed: Sep. 19, 2014

(65) Prior Publication Data

US 2015/0083033 A1 Mar. 26, 2015

(30) Foreign Application Priority Data

Sep. 24, 2013 (JP) ..... 2013-197154

(51) Int. Cl.
*D05B 35/02* (2006.01)
*D05B 35/10* (2006.01)

(52) U.S. Cl.
CPC ..... *D05B 35/02* (2013.01); *D05B 35/10* (2013.01); *D05D 2207/04* (2013.01)

(58) Field of Classification Search
CPC ..... D05B 35/02; D05B 35/062; D05B 35/10; D05B 35/04; D05B 35/102; D05D 2207/04
See application file for complete search history.

(56) References Cited

U.S. PATENT DOCUMENTS 3,776,156 A * 12/1973 Morgan ..... D05B 35/02 112/141
4,817,544 A * 4/1989 Ackermann ..... D05B 35/02 112/141
5,373,797 A * 12/1994 Bottoms ..... D05B 35/02 112/141
5,441,004 A * 8/1995 Bottoms ..... D05B 35/02 112/141

(Continued)

FOREIGN PATENT DOCUMENTS

JP S41-002985 2/1966
JP H02-12657 U 10/1990

(Continued)

OTHER PUBLICATIONS

Office Action for Japanese patent application No. 2013-197154 dated Jan. 5, 2016, 3 pages, and its English translation.

*Primary Examiner* — Nathan Durham
(74) *Attorney, Agent, or Firm* — Rudy J. Ng; Bret E. Field; Bozicevic, Field & Francis LLP

(57) ABSTRACT

A cloth edge curl correction device includes: a support plate extending along the direction of feed of a cloth at a front position of a turn-back guide device folding up and down over a given width the edge part of the cloth to be fed into a needle location position on a cylindrical bed; a cloth support provided near the support plate and supporting the cloth from the under; and an air ejection nozzle ejecting air toward a base part of the cloth support. Ejected air from the air ejection nozzle is applied to the edge of the cloth on the cloth support so that a curl generated in the edge is smoothed and corrected and then the cloth is fed in a manner that the edge goes along the support plate.

9 Claims, 7 Drawing Sheets

(56) References Cited

U.S. PATENT DOCUMENTS 6,119,612 A * 9/2000 Bottoms ..... D05B 35/04
112/141

FOREIGN PATENT DOCUMENTS

| | | | |
|---|---|---|---|
| JP | H02-126574 | U | 10/1990 |
| JP | H05-096075 | A | 4/1993 |
| JP | H08-191972 | A | 7/1996 |
| JP | 10-235054 | | 9/1998 |

* cited by examiner

CLOTH EDGE CURL CORRECTION DEVICE

CROSS-REFERENCE TO RELATED APPLICATIONS

This Nonprovisional application claims priority under 35 U.S.C.§119(a) on Patent Application No. 2013-197154 filed in Japan on Sep. 24, 2013, the entire contents of which are hereby incorporated by reference.

FIELD

The present invention relates to a device equipped in a sewing machine provided with a turn-back guide device arranged in front of a needle location position and correcting a curl generated in the edge of a cloth before introduction into the turn-back guide device.

BACKGROUND

For example, in sewing of a cuff portion and a bottom cuff portion of clothing, turn-back sewing is performed in which the edge part of the cloth is turned downward over a given width so as to be folded back under the remaining part of the cloth and then sewing of the vicinity of the edge is performed. When the turn-back sewing is to be performed by a common sewing machine, the edge of the cloth to be fed into the needle location position need be folded back with maintaining a fixed width by manual operation. This work causes a problem of requiring a great skill. In particular, when the cuff portion and the bottom cuff portion described above are to be processed, a cloth formed cylindrical in advance is to be processed. Thus, the work of folding back becomes more difficult and hence causes a possibility of poor sewing of diverse kind like a portion arises that the folding-back width is excessively small so that sewing of the edge is not achieved and, on the contrary, the folding-back width is excessively large so that the sewing line is formed at a position distant from the edge.

In view of such situations, in the conventional art, a sewing machine has been proposed that includes a turn-back guide device arranged in front of the needle location position (for example, see Japanese Patent Application Laid-Open No. H10-235054). The turn-back guide device includes: a guide plate overhanging, in parallel to a needle plate, a recess provided at a front position of the needle location position; a ruler member arranged in parallel to the upper face of the guide plate and bent at a position opposite to the tip part so as to be continuous to the bottom face of the recess; and an air ejection outlet opened at the bent part of the ruler member and ejecting air between the guide plate and the recess.

A cloth is supplied along the upper face of the guide plate in a state that the edge side is bent along the bending of the ruler member, and then fed in a direction along the tip edge of the guide plate. Air ejected from the air ejection outlet flows at a high speed between the lower face of the guide plate and the recess and biases the cloth overlapping with the lower face of the guide plate in a direction approximately perpendicular to the direction of feed so as to perform the operation of pressing the edge of the cloth against the deep inner side-end face of the recess.

By virtue of this, the cloth is folded up and down with the guide plate in between and the folding-back width on the edge side becomes a fixed width corresponding to the amount of overhang of the guide plate by virtue of the pressing against the end face of the recess. Thus, it is sufficient for the sewing worker to perform auxiliary work of, at a front position of the turn-back guide device, bending the edge side of the cloth over an appropriate width and then introducing it into a space between the ruler member and the recess. This permits reliable turn-back sewing over an appropriate width merely by causing a small labor load not requiring a skill.

Further, the turn-back guide device described in Japanese Patent Application Laid-Open No. H 10-235054 has a configuration that a nozzle ejecting air is arranged at a front position of the guide plate and the ruler plate so that even the turning of the edge side is automated by virtue of the ejected air from the nozzle and hence a labor load to the sewing worker is reduced further.

SUMMARY

However, in some cases, the turn-back sewing is to be performed on a cloth having a warpage referred to as a curl in the cloth edge. In such cases, correction operation that a curl generated in the cloth edge is continuously smoothed at a front position of the turn-back guide device is to be performed. The correction operation for a cloth edge curl is simpler than the folding-back operation described above. However, when the correction operation is performed by a sewing worker having little experience, a possibility arises that the cloth may be introduced into the turn-back guide device in a state that the correction is insufficient.

When the cloth having a cloth edge curl as described above is introduced into the turn-back guide device, turn-back is performed including the curl portion remaining in the cloth edge. As a result, turn-back sewing is performed in a state that the curl portion remains in the cloth posterior to sewing and hence causes a problem of poor sewing similar to the case of an excessively small or large folding-back width.

The present invention has been devised in view of such situations. An object thereof is to provide a cloth edge curl correction device that, when equipped in a sewing machine provided with a turn-back guide device, reliably corrects a curl generated in the cloth edge before introduction into the turn-back guide device so as to realize stable turn-back sewing of high quality without preparatory operation.

The cloth edge curl correction device according to the present invention is characterized by a cloth edge curl correction device that is equipped in a sewing machine provided with a turn-back guide device arranged in front of a needle location position on a sewing machine bed, then folding up and down over a given width an edge part of a cloth to be fed to the needle location position, and then feeding the cloth to the needle location position and that corrects a curl generated in the edge of the cloth to be fed into the turn-back guide device, comprising: a support plate extending along a direction of feed of the cloth at a front position of the turn-back guide device; a cloth support provided near the support plate and supporting the cloth from the under; and an air ejection nozzle ejecting air toward a base part of the cloth support; wherein ejected air from the air ejection nozzle is applied to the edge of the cloth on the cloth support so that a curl generated in the edge is smoothed and corrected and then the cloth is fed in a manner that the edge goes along the support plate.

The cloth edge curl correction device according to the present invention is characterized in that the cloth support includes support parts supporting the cloth at two positions apart frontward and rearward relative to the position of application of the ejected air and that the cloth edge curl correction device further comprises an air receiving plate arranged at a position closely under the cloth support between the support parts and receiving the ejected air.

The cloth edge curl correction device according to the present invention is characterized by further comprising a vent hole formed such as to penetrate the support plate in a vicinity of the position of application of the ejected air.

The cloth edge curl correction device according to the present invention is characterized in that the cloth support is arranged in an inclined manner that the front part is lowered.

The cloth edge curl correction device according to the present invention is characterized in that the support plate is attached in a manner of permitting position adjustment in the right and left directions at a front position of the sewing machine bed.

The cloth edge curl correction device according to the present invention is characterized by further comprising a second air ejection nozzle arranged in front of the air ejection nozzle and ejecting air toward the edge of the cloth prior to reaching the support plate so as to preparatorily correct a curl generated in the edge.

The cloth edge curl correction device according to the present invention is characterized by further comprising a turn-up member arranged at a front position of the cloth support in a manner of permitting position adjustment in the right and left directions and turning up the edge of the cloth extended by the ejected air from the second air ejection nozzle.

The cloth edge curl correction device according to the present invention is characterized by further comprising a third air ejection nozzle arranged behind the air ejection nozzle and ejecting air toward the edge of the cloth posterior to passing the support plate so as to re-correct the curl remaining in the edge.

The cloth edge curl correction device according to the present invention is characterized in that the cloth support protrudes from the support plate.

In the cloth edge curl correction device according to the present invention, at a front position of the turn-back guide device, the edge of a cloth is supported from the under by the cloth support and then ejected air from the air ejection nozzle is applied to the edge of the cloth on the cloth support. Thus, in a state that a curl generated in the edge is smoothed and corrected by the operation of the ejected air, the cloth is allowed to be fed and introduced into the turn-back guide device such that the edge goes along the support plate supporting the cloth support on one side. Thus, the present invention provides excellent effects that, for example, a curl generated in the cloth edge is allowed to reliably be corrected before introduction into the turn-back guide device so that stable turn-back sewing of high quality is allowed to be realized without preparatory operation.

The above and further objects and features of the invention will more fully be apparent from the following detailed description with accompanying drawings.

DETAILED DESCRIPTION

Figure 1:
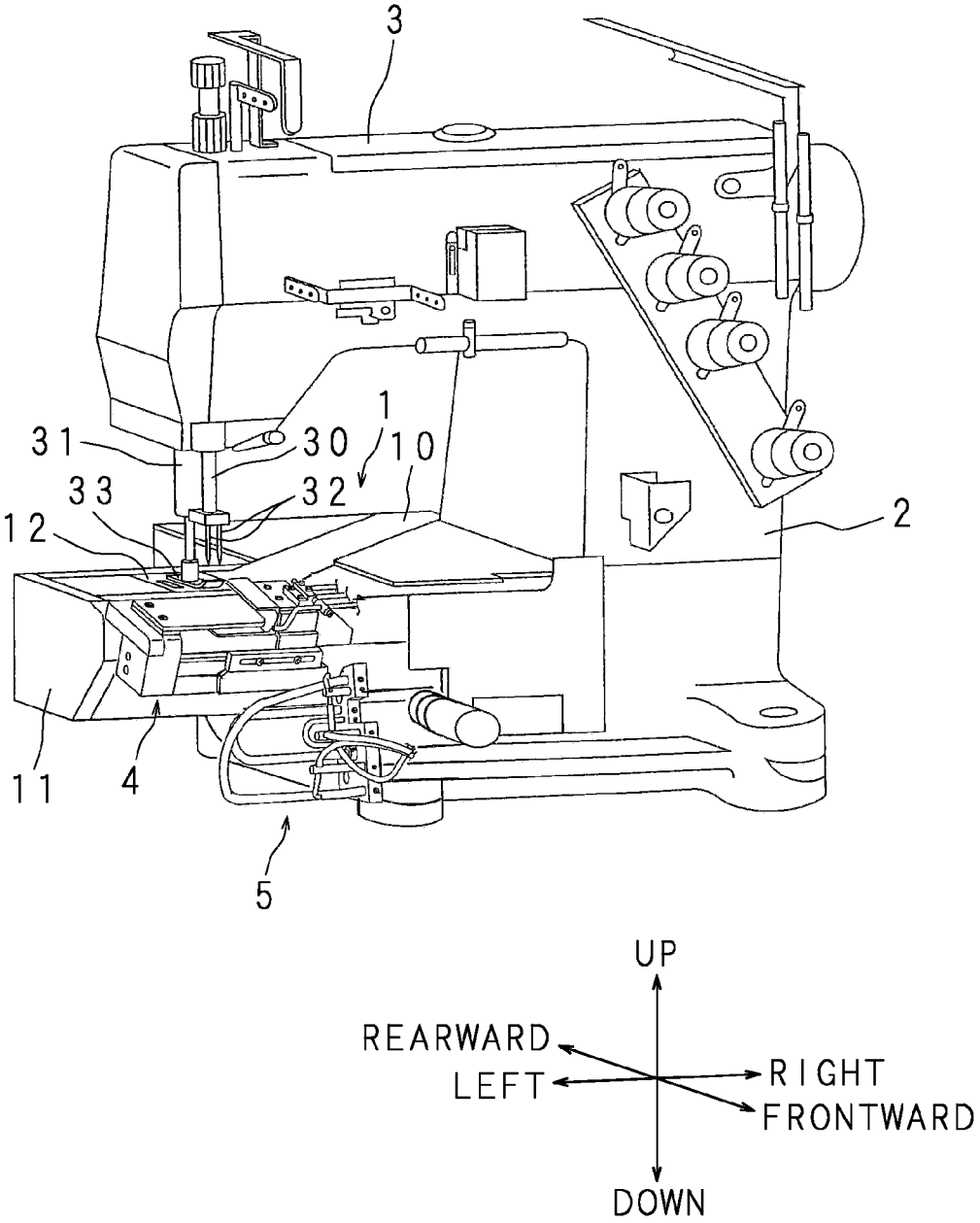
FIG. 1 is an external appearance perspective view of a sewing machine provided with a cloth edge curl correction device according to an embodiment.
Figure 2:
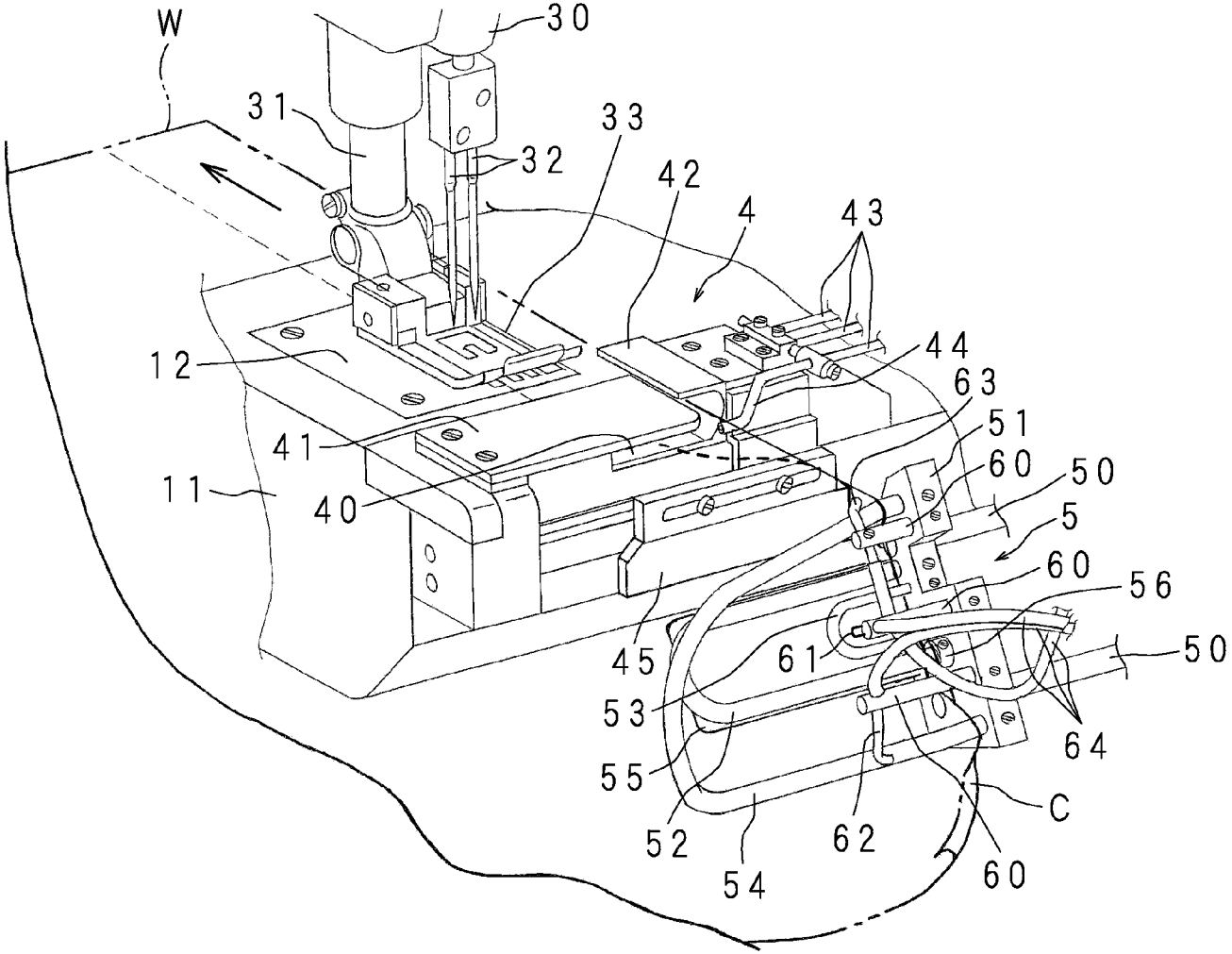
FIG. 2 is an enlarged perspective view illustrating the vicinity of a cloth edge curl correction device.

The present invention is described below in detail with reference to the drawings illustrating embodiments thereof. FIG. 1 is an external appearance perspective view of a sewing machine provided with a cloth edge curl correction device according to an embodiment. FIG. 2 is an enlarged perspective view illustrating the vicinity of the cloth edge curl correction device. In the following description, "up and down", "left and right", and "frontward and rearward" are used as indicated by arrows in FIG. 1. Here, the "frontward" indicates a side close to a sewing worker and the "rearward" indicates a side far from the sewing worker. The "left and right" indicate "left and right" viewed from the frontward.

As illustrated in FIG. 1, the sewing machine includes a sewing machine bed 1, a pedestal 2, and a sewing machine arm 3. The sewing machine bed 1 includes a bed body 10 having a rectangular box shape and a cylindrical bed 11 protruding leftward from the left side face of the bed body 10. The sewing machine is used in a state that the bed body 10 is fixed on a table (not illustrated). The upper face of the tip part of the cylindrical bed 11 is covered by a needle plate 12. In the inside of the cylindrical bed 11, a feed device and a looper device (not illustrated) are arranged at a position under the needle plate 12. The feed device and the looper device are linked through each drive mechanism in the bed body 10 to a sewing machine motor (not illustrated) serving as a driving source, and then individually perform publicly known operation in association with the drive of the sewing machine motor.

The pedestal 2 stands vertically on the right-side upper face of the bed body 10. The sewing machine arm 3 is provided continuous to the upper end part of the pedestal 2 and extends leftward in parallel to the cylindrical bed 11. In the left end part of the sewing machine arm 3, a needle bar 30 and a presser bar 31 are supported in a manner of being aligned frontward and rearward. The needle bar 30 and the presser bar 31 protrude downward from the sewing machine arm 3 and extend toward the needle plate 12 on the cylindrical bed 11. Then, a needle 32 and a presser plate 33 are attached individually to the lower end parts thereof.

The needle bar 30 is linked to the sewing machine motor through a needle bar drive mechanism provided in the sewing machine arm 3 and then moves up and down in association with the drive of the sewing machine motor. In association with the up and down movement of the needle bar 30, the needle 32 repeats ascent and descent in synchronization with the feed device and the looper device in the cylindrical bed 11.

The presser bar 31 moves up and down in association with operation by the sewing worker. The presser plate 33 performs ascent and descent in association with the up and down movement of the presser bar 31. At the time of descent, the presser plate 33 goes close to the needle plate 12 so as to pinch a cloth W with the needle plate 12 in between as described later. The cloth W pinched in this manner is fed rearward as indicated by an arrow in FIG. 2 by virtue of the operation of the feed device in the cylindrical bed 11. Then, by virtue of the operation of the needle 32 and the looper device in synchronization with the feed movement, sewing is achieved at the needle location position on the needle plate 12 (the position of descent of the needle 32).

The sewing machine further includes a turn-back guide device 4 and a cloth edge curl correction device 5. The turn-back guide device 4 is a publicly known device disclosed in Japanese Patent Application Laid-Open No. H10-235054 described above and includes: a guide plate 41 overhanging, in a rightward direction, a recess 40 provided in the upper face of the cylindrical bed 11 in front of the needle location position and oriented approximately in parallel to the needle plate 12; and a ruler member 42 arranged opposite in parallel to the upper face of the tip part of the guide plate 41 and having a shape bent downward similarly at a position apart from the tip edge by an interval so as to be continuous to the bottom face of the recess 40.

In the turn-back guide device 4, three air pipes 43 leading high pressure air from an air supply (not illustrated) are arranged and aligned frontward and rearward. Among these, the air pipe 43 located at the most frontward position is connected to an air ejection nozzle 44 and the two remaining air pipes 43 are individually connected to air ejection outlets (not illustrated) provided and aligned frontward and rearward on the inner side relative to the bent part of the ruler member 42. Here, it is sufficient that the number of air pipes 43 provided in an aligned manner is a plural number including the one located at the most frontward position.

The air ejection nozzle 44 ejects air supplied from the air pipe 43, leftward at a front position of the bent part of the ruler member 42. Further, the air ejection outlet in the inside of the ruler member 42 ejects air supplied from the air pipe 43, leftward between the bottom face of the recess 40 and the lower face of the guide plate 41. The ruler member 42, including the air ejection nozzle 44 and the support part of the air pipe 43, is attached to the front face of the cylindrical bed 11 with a base part 45 in between. The base part 45 is slidable in the right and left directions and the position of the ruler member 42 relative to the guide plate 41 is allowed to be changed.

The turn-back guide device 4 having this configuration performs the operation of turning downward the edge part of the cloth W over a given width in front of the needle location position such that the edge part is folded under the remaining part and then of feeding the cloth W. The ejected air from the air ejection nozzle 44 is applied to the edge part of the cloth W so as to perform the operation of turning the edge part downward so as to assist introduction into a space between the guide plate 41, the ruler member 42, and the recess 40.

The ejected air from the air ejection outlet provided in the ruler member 42 flows leftward at a high speed in a space between the opposite faces of the guide plate 41 and the recess 40 so as to perform the operation of biasing the edge part of the cloth W overlapping with the lower face of the guide plate 41 and thereby pressing the edge of the cloth W against the deep inner side-end face of the recess 40. By virtue of this, the edge part of the cloth W is brought into overlap with the remaining part over a fixed width corresponding to the overhang length of the guide plate 41 by virtue of guiding by the deep inner side-end face of the recess 40 and then, in this state, fed into the needle location position. At the needle location position, the sewing described above is achieved so that the vicinity of the edge of the cloth W is sewn to the overlapping portion located in the above.

As described above, in a case that such sewing is to be performed on a cloth W having a curl in the cloth edge, a possibility arises that the sewing is not normally achieved. The cloth edge curl correction device 5 is a device performing the operation of correcting a curl generated in the cloth W before introduction into the turn-back guide device 4 and includes: a support plate 51 supported by two support rods 50 and 50; and cloth supports 52, 53, and 54 and an air receiving plate 55 attached to the support plate 51.

The support rods 50 and 50 extend in the right and left directions in front of the cylindrical bed 11 and are slidable in the direction of extending. The support plate 51 is a flat-plate shaped member attached to the left end part of the support rods 50 and 50 in an orientation perpendicular thereto. Then, the position of the support plate 51 is allowed to be adjusted in the right and left directions at a front position of the cylindrical bed 11 in accordance with the slide movement of the support rods 50 and 50. The cloth supports 52, 53, and 54 are all bending-formed members obtained by bending a circular pipe into a U-shape and attached to the left side face of the support plate 51 in a manner that the bent part serving as a tip side extends leftward. The construction that the cloth supports 52, 53, and 54 protrude from the support plate 51 is described. But the construction is not limited to this one, the cloth supports 52, 53, and 54 may be provided near the support plate 51.

The cloth support 52 is located near the lower edge of the support plate 51 and arranged along the lower edge. The cloth support 53 has a shape smaller than and approximately similar to the cloth support 52 and is arranged at a position somewhat above the cloth support 52 such as to be contained in the inside. The cloth support 54 is formed in a width wider than the cloth support 52.

Then, the cloth support 54 is located near the upper edge of the support plate 51 and fixed along the upper edge. Further, the cloth support 54 is arranged above the cloth supports 52 and 53 in a manner of being apart by an interval.

The air receiving plate 55 is a flat plate formed in approximately the same size as the cloth support 52. One side of the air receiving plate 55 is fixed to the lower edge of the support plate 51 so that the air receiving plate 55 is fixed at a position close to the lower side of the cloth support 52 in parallel to the cloth support 52.

Further, a turn-up member 56 is attached to the base part of the front lower side of the cloth support 52. The turn-up member 56 is a collar having a cylindrical shape which is fitted onto the cloth support 52 and whose position is fixed with setscrews. Then, the position of the turn-up member 56 is allowed to be adjusted in the right and left directions along the cloth support 52.

The cloth edge curl correction device 5 further includes a first to a third air ejection nozzle 61, 62, and 63. The first to the third air ejection nozzles 61, 62, and 63 are supported by individual support rods 60, 60, and 60 standing and aligned frontward and rearward at a position above the left side face of the support plate 51, and connected to an air supply (not illustrated) through individual air pipes 64, 64, and 64 so as to eject, through each tip, air supplied from each air pipe 64.

The first air ejection nozzle 61 is supported by the support rod 60 located in the center and ejects air from the above of the cloth supports 52 and 53 toward the linkage part between the support plate 51 and the air receiving plate 55. The support plate 51 is provided with a vent hole 65 (see FIGS. 3 and 5) formed at a position above the air receiving plate 55 such as to penetrate in the right and left directions. Then, a large part of the ejected air from the first air ejection nozzle 61 escapes to the right side of the support plate 51 through the vent hole 65.

The second air ejection nozzle 62 is provided such as to be supported by the support rod 60 located on the front side, extend frontward of the support rod 60, and eject air right downward at a front position relative to the front end part of the support plate 51.

The third air ejection nozzle 63 is provided such as to be supported by the support rod 60 located on the rear side, extend rearward of the support rod 60, and eject air right downward at a rear position relative to the rear end part of the support plate 51.

The cloth edge curl correction device 5 having the above-mentioned configuration is used in such a manner that, as indicated by a double-dotted chain line in FIG. 2, a cloth W having a curl portion C in the edge is placed and supported on the cloth support 54 so as to be set in a state that the portion of the front and rear support parts supported by the cloth support 54 is inserted between the cloth supports 52 and 53 and then air is ejected from the first to the third air ejection nozzles 61, 62, and 63. Here, the frontward portion of the cloth W is pinched between the needle plate 12 and the presser plate 33 in a state that the edge side is folded back over a given width. Then, the portion continuous to the rear side of the pinching position is set into the turn-back guide device 4 as illustrated in the figure. As described above, the cloth W having been set in this manner reaches the needle location position in a state that the edge side is folded back over a fixed width by the turn-back guide device 4, and then is fed rearward after the vicinity of the edge is sewn at the needle location position.

Figure 3:
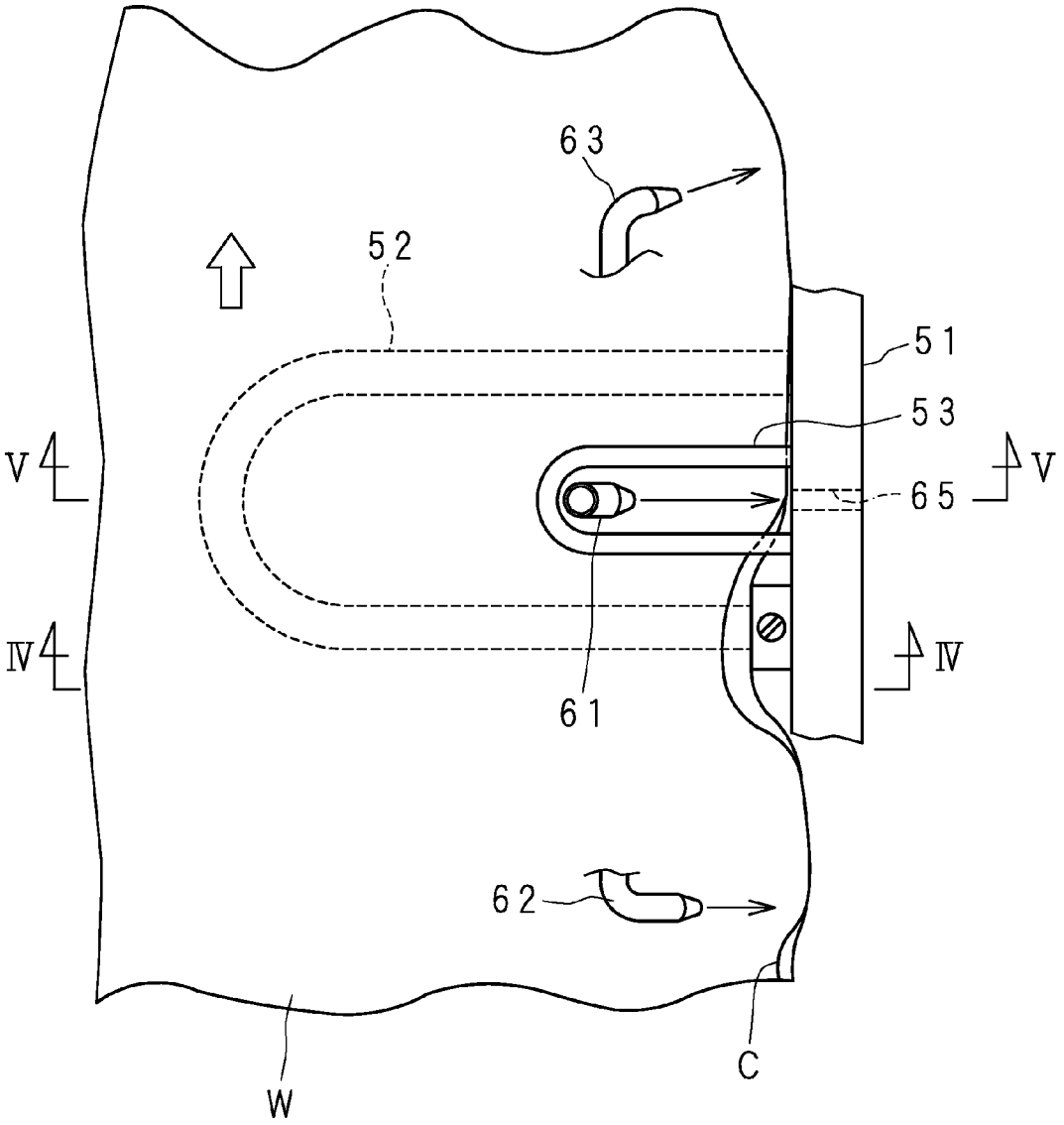
FIG. 3 is an explanation diagram for the operation of a cloth edge curl correction device.
Figure 4:
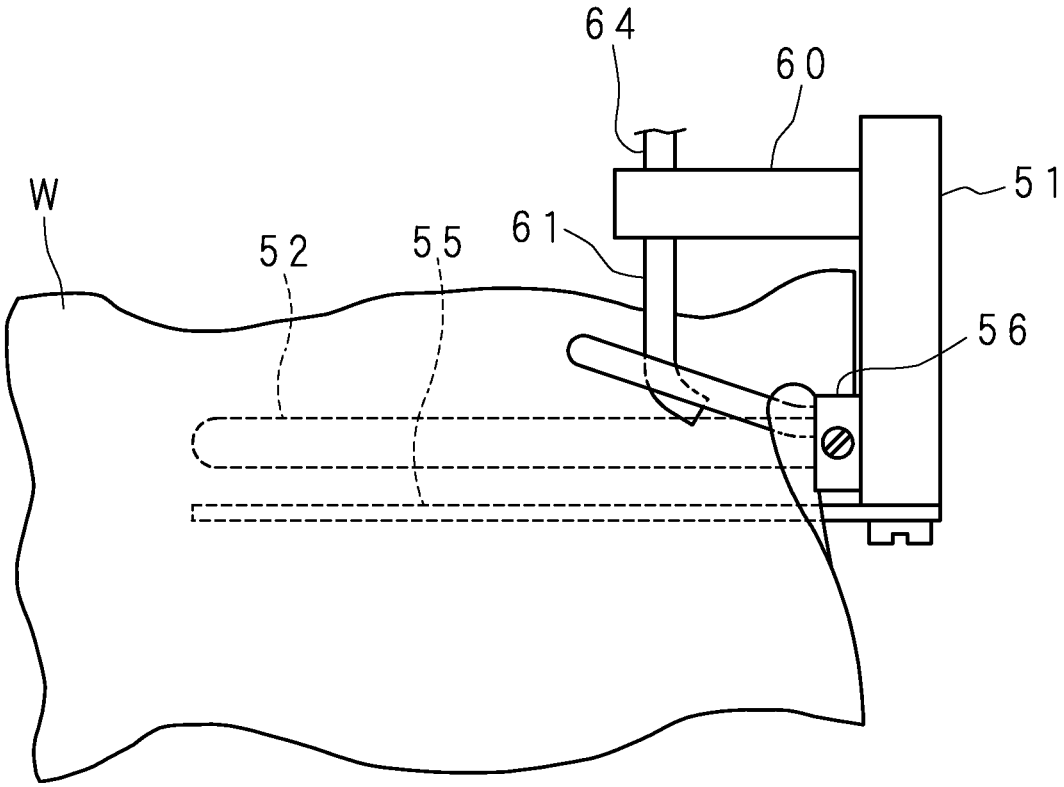
FIG. 4 is an explanation diagram for the operation of a cloth edge curl correction device.
Figure 5:
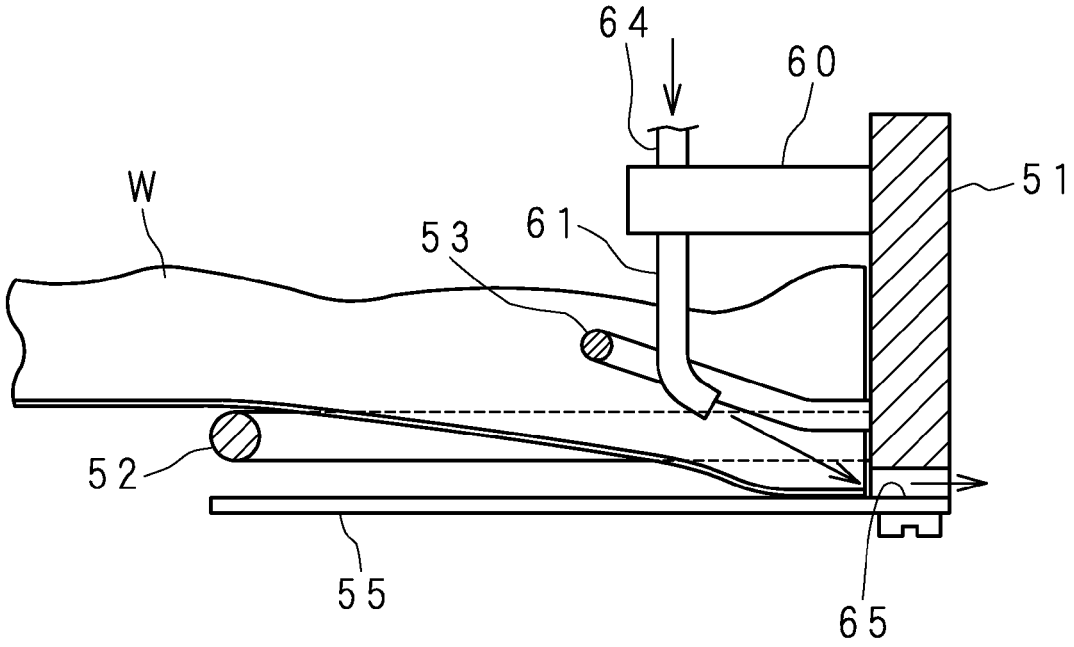
FIG. 5 is an explanation diagram for the operation of a cloth edge curl correction device.

FIGS. 3 to 6 are explanation diagrams for the operation of the cloth edge curl correction device 5. FIG. 3 is a plan view illustrating a situation of the cloth W in the forward and rearward of the first air ejection nozzle 61. FIG. 4 is a sectional view taken along line IV-IV in FIG. 3. FIG. 5 is a similar sectional view taken along line V-V.

The open-face arrow in FIG. 3 indicates the direction of feed movement for the cloth W. The cloth W having been set as described above is fed and moved in a manner that the edge goes along the left side face of the support plate 51. In the course of this movement, ejected air from the first to the third air ejection nozzles 61, 62, and 63 is applied to the edge. This application of air is performed by the second air ejection nozzle 62 located at the most frontward position. As indicated by an arrow in FIG. 3, the ejected air from the second air ejection nozzle 62 hits the curl portion C generated in the edge of the cloth W so as to perform the operation of pressing and smoothing the curl portion C in the rightward direction. The second air ejection nozzle 62 performs the operation of ejecting air toward the edge of the cloth W prior to reaching the support plate 51 so as to preparatorily correct the curl portion C generated in the edge.

The cloth W reaches the support plate 51 in a state that the curl portion C has preparatorily been corrected, and then is introduced into a space between the cloth support 52 and the cloth support 53. Before this introduction, the edge of the cloth W hits the turn-up member 56 provided in the front base part of the cloth support 52. The turn-up member 56 performs the operation of pushing up the edge of the cloth W whose curl portion C has been corrected by the preparatory correction so as to turn up the edge part over an appropriate width. FIG. 4 is a sectional view taken at the position of arrangement of the turn-up member 56.

The cloth W advances in a state that the turn-up has been achieved, and then reaches the position of arrangement of the first air ejection nozzle 61. The ejected air from the first air ejection nozzle 61 is applied to the upper face of the cloth W in the center part of the cloth support 52 and flows rightward along the upper face at a high speed so as to bias rightward the cloth W on the cloth support 52 and thereby perform the operation of pressing the edge of the cloth W against the left side face of the support plate 51. The ejected air from the first air ejection nozzle 61 hits the turned-up portion generated by the operation of the turn-up member 56. Thus, the cloth W is reliably biased rightward and the edge is pressed against the left side face of the support plate 51 so that the curl portion C is allowed to be smoothed and corrected.

The ejected air from the first air ejection nozzle 61 presses the cloth W downward also. However, as illustrated in FIG. 5, the cloth W displaced downward by this pressing is restricted by the air receiving plate 55 arranged under the cloth support 52 and the ejected air escapes to the right side of the support plate 51 through the vent hole 65 provided at a position above the air receiving plate 55.

The preparatory correction for the curl portion C by using the ejected air from the second air ejection nozzle 62 is not indispensable. However, in a case that a cloth W having a curl portion C of diverse shape is to be processed, it is preferable that the second air ejection nozzle 62 is provided so that the shape of the curl portion C is brought into a common shape before the main correction using the ejected air from the first air ejection nozzle 61. The turn-up member 56 is used when the preparatory correction has been performed, and performs the operation of turning up the edge of the cloth W whose curl portion C has been corrected by preparatory correction and thereby ensuring the hit of the ejected air from the first air ejection nozzle 61. The position of the turn-up member 56 is allowed to be adjusted in the right and left directions. This adjustment is performed, for example, when the amount of turn-up by the turn-up member 56 is to be adjusted in accordance with the type of the cloth W.

Figure 6:
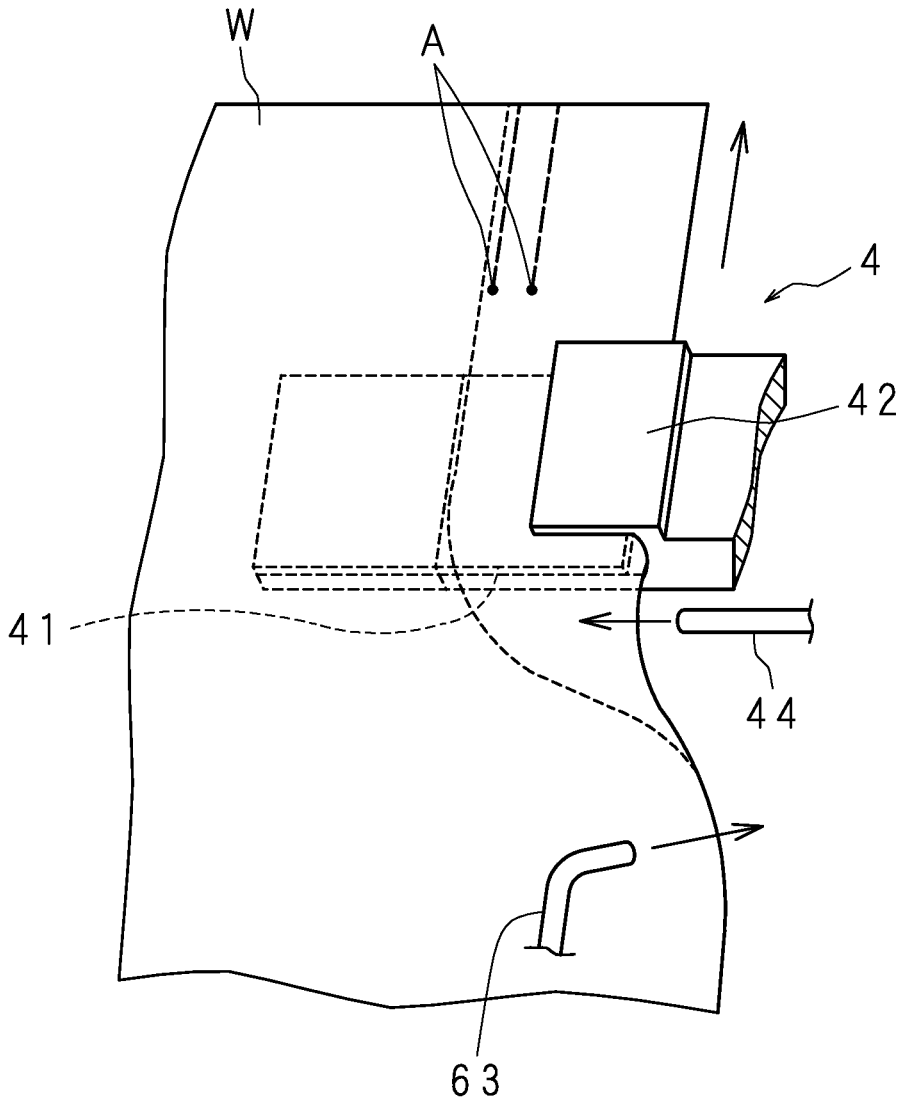
FIG. 6 is an explanation diagram for the operation of a cloth edge curl correction device.

As described above, the cloth W is corrected in the curl portion C by virtue of the operation of the ejected air from the first air ejection nozzle 61, and then fed in a state that the edge goes along the left side face of the support plate 51. As indicated by an arrow in FIG. 3, the ejected air from the third air ejection nozzle 63 is applied to the edge of the cloth W having passed the support plate 51 so as to perform the operation of re-correcting a curl remaining in the edge. As illustrated in FIG. 6, this re-correction is supplementarily achieved also by the ejected air from the air ejection nozzle 44 provided in the turn-back guide device 4. The cloth W is introduced into the turn-back guide device 4 in a state that the cloth edge curl is corrected reliably. Thus, turn-back sewing of high quality is stably achieved at the needle location positions A and A illustrated in FIG. 6. Such turn-back sewing is allowed to be achieved merely by setting the cloth W to the cloth edge curl correction device 5 as described above, and hence is allowed to be performed even by a sewing worker having little experience.

Figure 7:
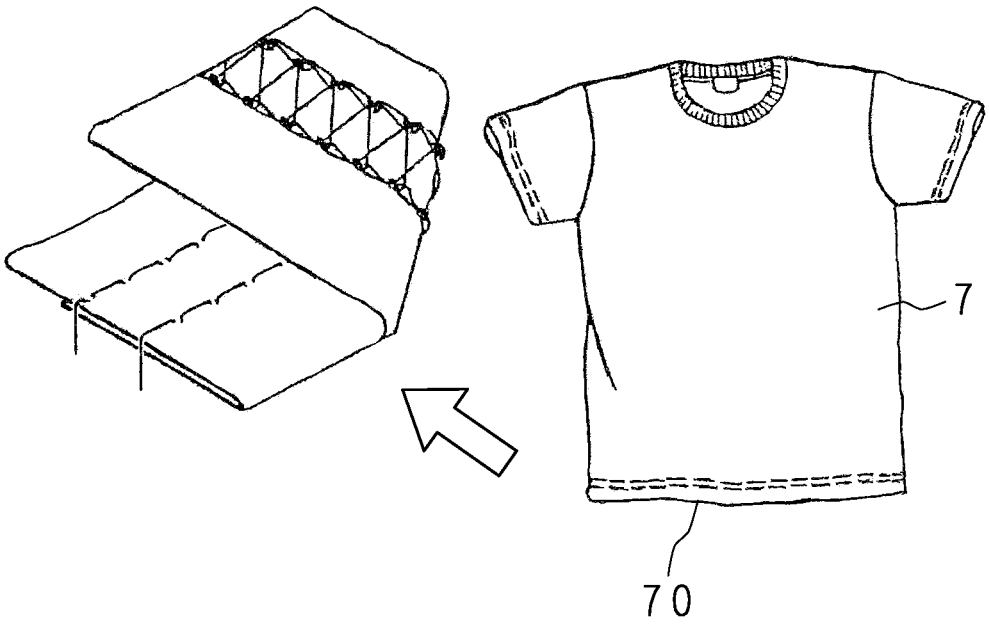
FIG. 7 is a diagram illustrating an example of a sewing object to which turn-back sewing is applied.

FIG. 7 is a diagram illustrating an example of a sewing object to which turn-back sewing is applied. In some cases, such turn-back sewing is performed on a sewing part having been formed in a cylindrical shape in advance like a bottom cuff portion 70 of clothing 7 illustrated in the present figure. As illustrated in FIG. 2, the cloth supports 52, 53, and 54 of the cloth edge curl correction device 5 are arranged in an inclined manner that the front part is lowered at a front position of the cylindrical bed 11, and arranged along the circumference of a circle together with the cylindrical bed 11. Thus, the clothing 7 is allowed to be set in a state that the cylindrical sewing part such as the bottom cuff portion 70 is fitted onto these cloth supports 52, 53, and 54. Thus, turn-back sewing is allowed to easily be applied even to such a cylindrical sewing part.

Further, the cloth edge curl correction device 5 includes the support plate 51 whose position is allowed to be adjusted in the right and left directions at a front position of the cylindrical bed 11. Thus, when position adjustment of the support plate 51 is performed, turn-back sewing is allowed to be applied to a diverse width.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A cloth edge curl correction device that is equipped in a sewing machine provided with a turn-back guide device arranged in front of a needle location position on a sewing machine bed, then folding up and down over a given width an edge part of a cloth to be fed to the needle location position, and then feeding the cloth to the needle location position and that corrects a curl generated in the edge of the cloth to be fed into the turn-back guide device, comprising:

a support plate extending along a direction of feed of the cloth at a front position of the turn-back guide device;

a cloth support provided near the support plate and supporting the cloth from the under; and an air ejection nozzle ejecting air toward a base part of the cloth support;

wherein ejected air from the air ejection nozzle is applied to the edge of the cloth on the cloth support so that a curl generated in the edge is smoothed and corrected and then the cloth is fed in a manner that the edge goes along the support plate, and the cloth support includes support parts supporting the cloth at two positions apart frontward and rearward relative to the position of application of the ejected air, further comprising:

an air receiving plate arranged at a position closely under the cloth support between the support parts and receiving the ejected air; and a vent hole formed such as to penetrate the support plate in a vicinity of the position of application of the ejected air, wherein ejected air from the air ejection nozzle escapes to one side of the support plate through the vent hole.

2. The cloth edge curl correction device according to claim 1, wherein the cloth support is arranged in an inclined manner that the front part is lowered.

3. The cloth edge curl correction device according to claim 1, further comprising a second air ejection nozzle arranged in front of the air ejection nozzle and ejecting air toward the edge of the cloth prior to reaching the support plate so as to preparatorily correct a curl generated in the edge.

4. The cloth edge curl correction device according to claim 1, further comprising a third air ejection nozzle arranged behind the air ejection nozzle and ejecting air toward the edge of the cloth posterior to passing the support plate so as to re-correct the curl remaining in the edge.

5. The cloth edge curl correction device according to claim 1, wherein the cloth support protrudes from the support plate.

6. The cloth edge curl correction device according to claim 1, further comprising a second cloth support positioned above the cloth support.

7. The cloth edge curl correction device according to claim 6, wherein the second cloth support protrudes from the support plate.

8. A cloth edge curl correction device that is equipped in a sewing machine provided with a turn-back guide device arranged in front of a needle location position on a sewing machine bed, then folding up and down over a given width an edge part of a cloth to be fed to the needle location position, and then feeding the cloth to the needle location position and that corrects a curl generated in the edge of the cloth to be fed into the turn-back guide device, comprising:

a support plate extending along a direction of feed of the cloth at a front position of the turn-back guide device;

a cloth support provided near the support plate and supporting the cloth from the under; and an air ejection nozzle ejecting air toward a base part of the cloth support;

wherein ejected air from the air ejection nozzle is applied to the edge of the cloth on the cloth support so that a curl generated in the edge is smoothed and corrected and then the cloth is fed in a manner that the edge goes along the support plate, and the support plate is attached in a manner of permitting position adjustment in the right and left directions at a front position of the sewing machine bed, further comprising:

a support rod adjusting a position of the support plate in the right and left directions.

9. A cloth edge curl correction device that is equipped in a sewing machine provided with a turn-back guide device arranged in front of a needle location position on a sewing machine bed, then folding up and down over a given width an edge part of a cloth to be fed to the needle location position, and then feeding the cloth to the needle location position and that corrects a curl generated in the edge of the cloth to be fed into the turn-back guide device, comprising:

a support plate extending along a direction of feed of the cloth at a front position of the turn-back guide device;

a cloth support provided near the support plate and supporting the cloth from the under; and an air ejection nozzle ejecting air toward a base part of the cloth support;

wherein ejected air from the air ejection nozzle is applied to the edge of the cloth on the cloth support so that a curl generated in the edge is smoothed and corrected and then the cloth is fed in a manner that the edge goes along the support plate, further comprising:

a second air ejection nozzle arranged in front of the air ejection nozzle and ejecting air toward the edge of the cloth prior to reaching the support plate so as to preparatorily correct a curl generated in the edge; and a turn-up member arranged at a front position of the cloth support in a manner of permitting position adjustment in the right and left directions and turning up the edge of the cloth extended by the ejected air from the second air ejection nozzle.

* * * * *